US006065252A

United States Patent [19]

Norsen

[11] Patent Number: 6,065,252

[45] Date of Patent: May 23, 2000

[54] PNEUMATICALLY CONVERTIBLE ROOF

[76] Inventor: Robert A. Norsen, 9616 Fauntleroy Way SW., Seattle, Wash. 98136

[21] Appl. No.: 08/546,042

[22] Filed: Oct. 20, 1995

[51] Int. Cl.[7] ..... E04B 1/343

[52] U.S. Cl. ..... 52/66; 52/2.11; 52/6; 52/2.18

[58] Field of Search ..... 52/2.11, 2.13, 52/2.17, 2.18, 6, 66, 68

[56] References Cited

U.S. PATENT DOCUMENTS

| | | | |
|---|---|---|---|
| 2,782,794 | 2/1957 | White | 52/2.19 |
| 3,332,176 | 7/1967 | Knetzer . | |
| 3,497,606 | 2/1970 | Camink et al. | 52/2.17 X |
| 3,858,372 | 1/1975 | Wilson . | |
| 4,317,315 | 3/1982 | LeBlang . | |
| 4,738,057 | 4/1988 | Logan | 52/2.17 |
| 4,833,837 | 5/1989 | Bonneau . | |
| 4,920,706 | 5/1990 | Fischer | 52/2.11 X |
| 5,097,548 | 3/1992 | Heck et al. | 52/2.18 X |
| 5,303,516 | 4/1994 | Delamare | 52/2.11 |

FOREIGN PATENT DOCUMENTS

| | | | |
|---|---|---|---|
| 2041757 | 4/1978 | Germany | 52/2.11 |
| 6151914 | 6/1994 | Japan | 52/2.11 |
| 6317045 | 11/1994 | Japan | 52/2.11 |
| 1516595 | 10/1989 | Russian Federation | 52/2.11 |
| WO93/11330 | 7/1993 | WIPO | 52/2.11 |

OTHER PUBLICATIONS

*Birdair Air Structured Supports* Brochure (copy), 4 pgs., printed Mar. 1995.

*Primary Examiner*—Carl D. Friedman
*Assistant Examiner*—Winnie S. Vip
*Attorney, Agent, or Firm*—Christensen O'Connor Johnson & Kindness PLLC

[57] ABSTRACT

A convertible roof (20) moves between extended and retracted positions for selectively covering an area, or exposing the area to ambient weather conditions. The roof (20) includes a first panel (26) having a plurality of inflatable tubes (28). One end of each tube connects to one side of the base of the roof and the other end connects to the other side of the roof's base. An air compressor (42) inflates the tubes sequentially via valves (40) and air duct anchor posts (30) or (112) for causing the first panel to move by inflation air pressure. The inflation air pressure causes the first panel to move from a position extending along one end of the base when the tubes are evacuated, to a second position above the base when the tubes inflate for covering the base. The roof will usually, but not necessarily, include a second panel (26) substantially identical to the first panel. The second panel connects to the end of the base of the roof opposite the end the first panel connects to. An air compressor also inflates the tubes of the second panel and causes the second panel to move by inflation air pressure in substantially the same way as the first panel.

11 Claims, 10 Drawing Sheets

8/10

PNEUMATICALLY CONVERTIBLE ROOF

FIELD OF THE INVENTION

The present invention relates generally to structures pneumatically convertible between stored and erected configurations, and in particular to pneumatically convertible roofs.

BACKGROUND OF THE INVENTION

Convertible roofs offer protection from inclement weather and enjoyment of activities in the open during suitable weather. More particularly, convertible roofs may be stored or erected for selectively covering an area, or exposing the area to ambient weather conditions. During suitable weather conditions, some activities are more enjoyable in the open. Further, some sports require natural turf and satisfactory cultivation of large turf areas generally requires open exposure.

However, severe weather conditions render some activities unacceptable for the activity and/or for the observers. For instance, soccer requires natural turf; but under some conditions the game destroys the turf and discourages the fans. Baseball games are "called" due to rain, at great expense in enthusiasm and money. Swimming pools are delightful when used in warm sunny weather but impossible in cold, windy conditions. Ice rinks are delightful in mild cold but impossible in extreme cold or in warm weather. Many other activities can be imagined where a convertible roof is desirable for selectively retracting and extending the roof in response to different weather conditions. Past convertible roofs have been complex, mechanical, expensive, unreliable, hazardous in earthquake conditions, visibly invasive even when retracted, and not accepted for many reasons.

Attempts to develop convertible roofs using fabrics and pneumatics are disclosed in prior patents. For example U.S. Pat. No. 4,833,837 to Bonneau discloses a folding radome for use in sports, scientific, military or industrial applications. The radome includes a flexible roof having two hemispherical halves. In this roof system, inflated panels are supported by structural arches. The panels are stretched into place by mechanical winch systems. Complex mechanics and expensive permanent structure visually obstructs the area the roof covers, even when the roof retracts.

U.S. Pat. No. 3,332,176 to Knetzer discloses an inflatable structure that forms a hemispherical dome using guidance and support from internal bracing. Lune-shaped cells are interconnected pneumatically by valves that transfer inflation from cell to cell as scheduled pressure differentials are reached. Complex valving and internal supports limit the applications for which the disclosed structure may be used. For example, the internal support bracing precludes safe and smooth convertible action of the structure over an occupied space. Additionally, the valving reduces the rate of closing and opening of the structure below acceptable limits for many uses.

U.S. Pat. No. 4,317,315 to LeBlang discloses a shelter having two halves. Inflatable ribs form a structure for a flexible skin. The two halves are erected separately with high pressure in the structural tubes laced together to form a portable, tent-like structure. The system does not lend itself to being convertible over a large area or while the area is occupied.

The present invention accordingly provides an improved solution for a convertible roof.

SUMMARY OF THE INVENTION

The present invention provides a retractable roof having a base. The roof includes a first panel having a plurality of inflatable tubes. One end of each tube connects to one side of the base of the roof and the other end connects to the other side of the roof's base. An air pump or compressor inflates the tubes and causes the first panel to move by inflation air pressure. The inflation air pressure causes the first panel to move from a position extending along one end of the base when the tubes are deflated, to a second position above the base when the tubes inflate for covering the base.

Roofs, in accordance with the invention, will usually include a second panel substantially identical to the first panel. The panels connect to opposite ends of the base of the roof, and when both panels extend, the panels meet for closing the roof. An air pump or compressor also inflates the tubes of the second panel and causes the second panel to move by inflation air pressure. The inflation air pressure causes the second panel to move from a position extending along its respective end of the base, to a second position above the base contacting the first panel when the tubes of the first and second panels inflate. In a preferred embodiment, a vacuum system forms a partial vacuum between the sections of the first and second panels that contact one another when fully inflated for sealing the first and second panels to one another.

The base of the roof includes a trough that extends around the periphery of the base. When the panels retract, the trough receives and protects deflated tubes. Tubular anchor posts in the trough anchor the ends of each tube in the trough. Additionally, ducts connected to the posts direct air through the posts for inflating and evacuating the tubes.

Adjacent tubes in a panel connect or seal to one another for at least a portion of their lengths using methods that permit the tubes to shift along their lengths relative to one another. In a preferred embodiment, the method employs labyrinth seals. The labyrinth seals substantially prevent transverse movement of tubes relative to one another, and substantially prevents moisture, such as rain, from penetrating between two adjacent tubes.

The tubes are formed from a translucent material for transmitting light, and at least some of these tubes are light control tubes. Each light control tube includes an inflatable light-blocking section connected to one side of the interior of the tube. When the light blocking section inflates, it expands and blocks a significant amount of light that would otherwise pass through the tube. When the light-blocking section deflates, it contracts and permits significantly more light to pass through the tube. The blocking section may simply be a colored, translucent material that filters the light to perform the blocking function.

Alternate embodiments of the invention include retractable roofs that include a single panel for extending against, and retracting from a wall. Other embodiments include inflatable tubes forced to expand or retract along predefined tracks for forming convertible walls or other structures.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
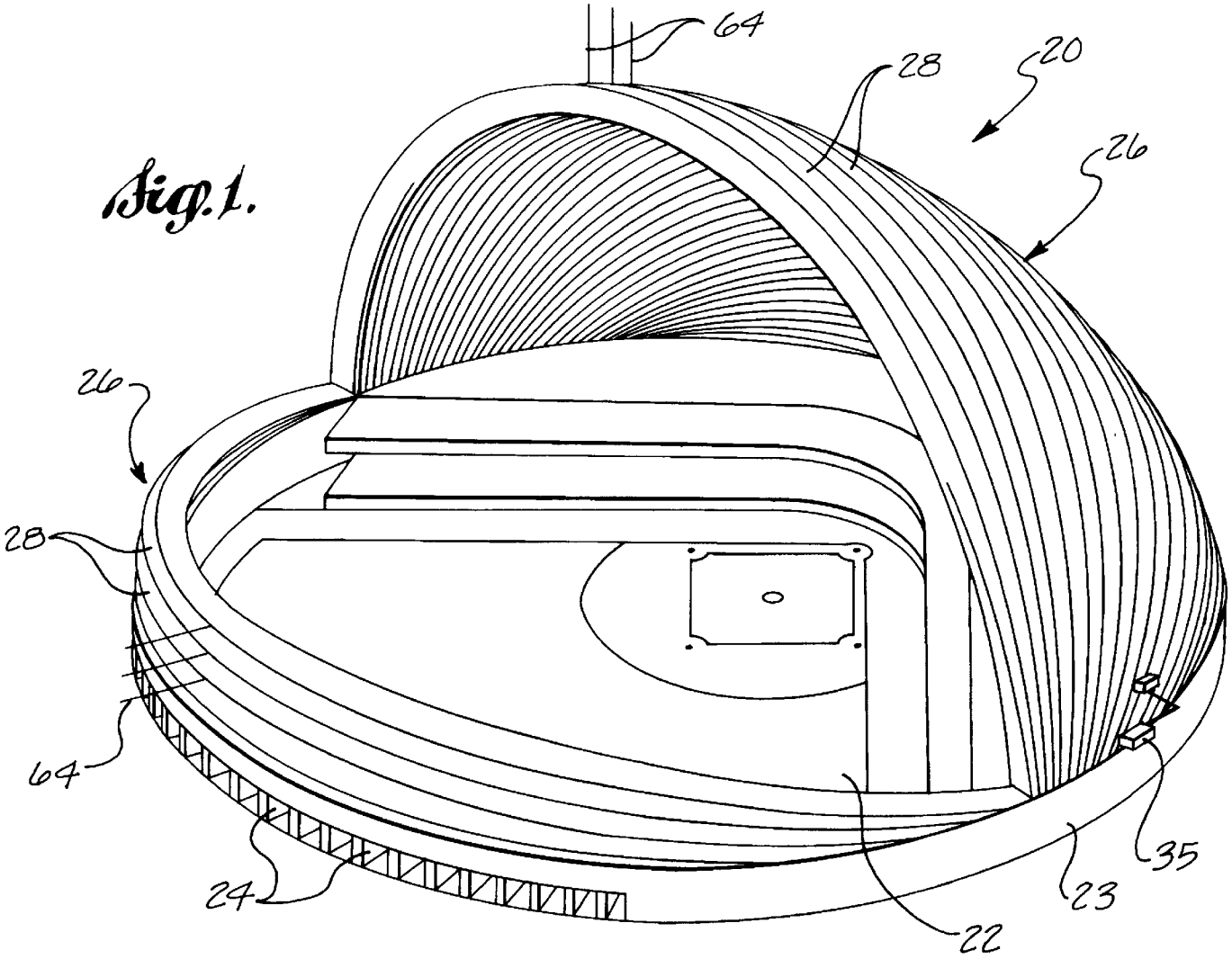
FIG. 1 illustrates a perspective view of a convertible roof in accordance with the present invention being used in a sports stadium application.
Figures 11A, 11B:
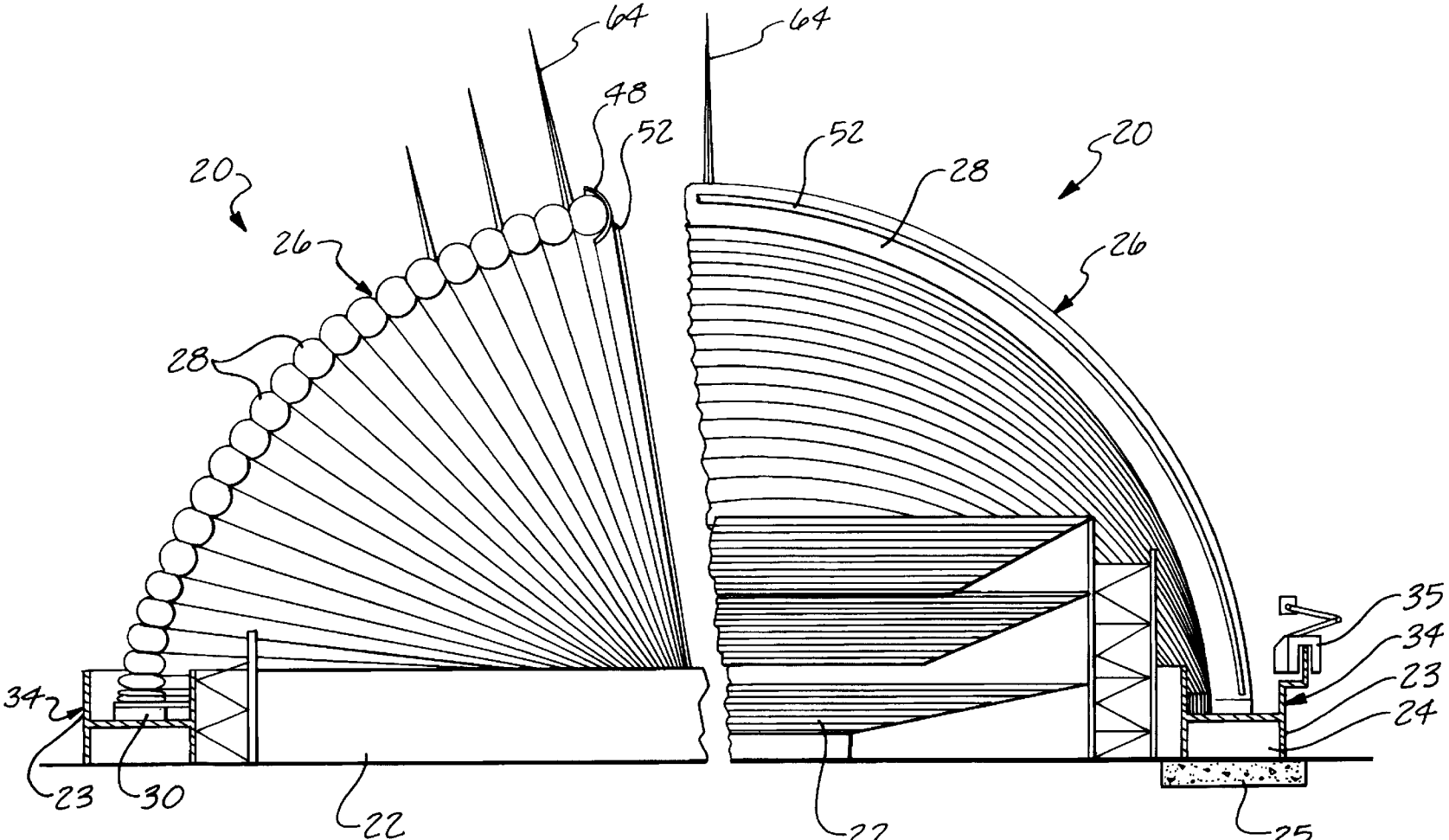
FIGS. 11A and 11B illustrate cross-sectional views of the roof of FIG. 1.

FIG. 1 illustrates a preferred embodiment of a pneumatically convertible roof 20 in accordance with the present invention installed on a sports stadium 22. The base of the roof 20 mounts to a low entryway, walkway or wall 23 encircling the stadium 22. People enter the stadium 22 through entrances 24 in the wall 23 below the roof 20. Referring to FIG. 11A, anchors 25 in the ground below the stadium 22 may connect to the wall 23 to resist wind forces acting against the roof 20.

The roof 20 includes two opposing, individually retractable panels 26. The panels 26 connect to opposite ends of the base of the roof 20, and therefore extend and retract from opposite sides of the stadium 22. When fully extended, the periphery of the panels 26 contact one another above the stadium 22 to enclose the stadium from the elements. When fully retracted, the periphery of each panel 26 lies along its respective end of the roof 20 on opposite sides of the stadium from one another. FIG. 1 illustrates one of the panels 26 fully extended and the other panel partially retracted.

In other embodiments, roofs in accordance with the present invention may employ a single panel. In single panel embodiments, the panel extends against, and retracts from, a substantially immovable structure, such as wall.

The panels 26 in the roof 20 of FIG. 1 each include a plurality of inflatable, arcuate tubes 28. One end of each tube 28 connects to one side of the base of the roof 20 and the other end connects to the opposite side of the roof's base. The tubes 28 extend continuously along each panel 26 in a side-by-side relationship to form the main body section for each panel. Each tube 28 connects to an adjacent tube along the length of both tubes.

Figures 2, 3:
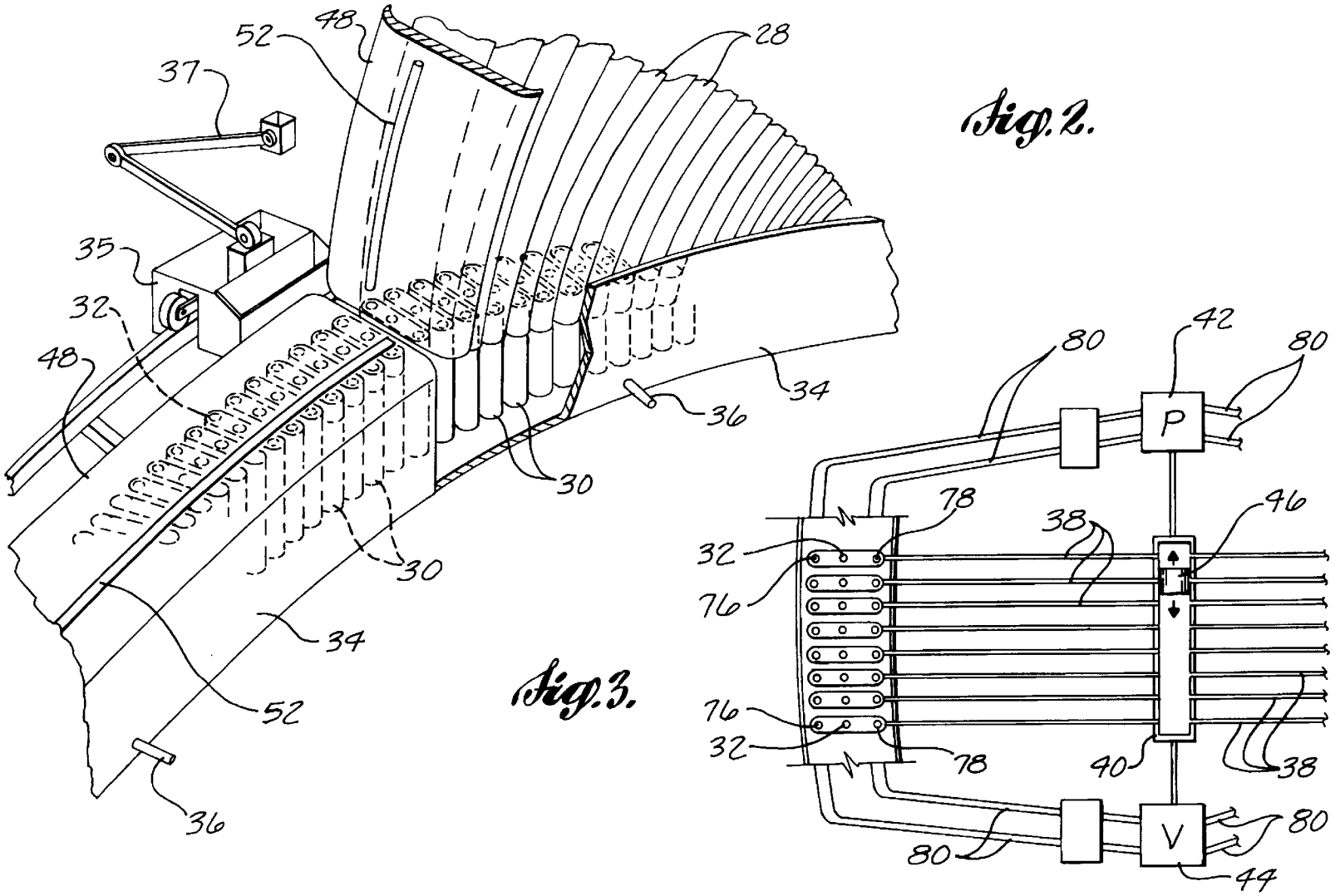
FIG. 2 illustrates a perspective view of a part of the base of the roof of FIG. 1.
FIG. 3 illustrates a schematic view of part of the base of the roof of FIG. 1 and pneumatic valving for the roof.

Referring to FIG. 2, the ends of the tubes 28 each connect to a tubular air duct anchor post 30 for inflation and deflation of the tubes. Each post 30 projects upward from the top of a stadium wall 23 in a side-by-side arrangement. Viewed from the top as shown in FIG. 3, each post 30 defines a generally oval shape, having the minor axis of the oval directed generally along the center line of the stadium wall. Each end of a tube 28 seals around the outer periphery of the post 30 that it connects to for receiving compressed air for inflating the tube, or for application of vacuum for deflating or evacuating the tube. Specifically, air flows through a central port 32 in the top of each post 30 for inflating or evacuating a tube 28. The posts 30 inflate and evacuate the tubes 28 from one or both ends of each tube.

The retractable roof 20 includes a trough 34 as shown in FIG. 2, which extends along the top of the stadium wall 23. The posts 30 of a roof panel 26 project from the bottom of the trough 34 and decrease in height in the direction away from the tubes 28 of the other roof panel. Along this direction, each post 30 decreases in height an amount approximately equal to the thickness of an evacuated tube 28 until the last post is reached on that side of the roof panel 26. The last post 30 projects above the bottom of the trough 34 by an amount approximately equal to the thickness of an evacuated tube 28. When a roof panel 26 fully retracts, the height decrease permits evacuated tubes 28 to lie at approximately a horizontal orientation on top of other deflated tubes within the trough 34.

The trough 34 protects deflated tubes 28 and retains the tubes along the top of the stadium wall 23. Drains 36 in the bottom of the trough 34 prevent water from accumulating in the trough. The trough 34 has a width exceeding the width of the tubes 28 so that personnel can gain access to the tubes in the trough for initial assembly of the roof 20 and maintenance. A trolley 35 having an extension boom 37 can be provided for movement along the trough 34 for facilitating assembly and maintenance of the roof 20.

Inflation air pressure causes the roof panels 26 to extend. Application of a partial vacuum to the tubes 28 causes the roof panels 26 to retract. When a roof panel 26 extends, the tubes 28 inflate in the following sequence. The tube 28 connected to the tallest posts 30 of a roof panel 26 inflates first, followed by the tube connected to the next tallest posts, and so on until the tube connected to the shortest posts inflates. When a roof panel 26 retracts, the tubes 28 deflate or evacuate in reverse order from which the tubes inflate.

The posts 30 connect through air pathways or ducts 38 to a valve 40 as shown in FIG. 3 for inflating and evacuating the tubes 28. The valve 40 controls the sequence in which the tubes 28 inflate and evacuate. The valve 40 may be any known type of valve for controlling the sequence of fluid communication access to a plurality of ports. FIG. 3 schematically illustrates a linear type of valve 40. An air compressor 42 connects to the pressure end of the valve 40 for inflating the tubes 28 and an air pump 44 connects to the vacuum end of the valve for deflating or evacuating the tubes. Air lines or ducts 38 extend sequentially from along both sides of the valve 40 to the anchor posts 30. The pair of ducts 38 nearest the pressure end of the valve 40 connect to the tallest anchor posts 30 of a roof panel 26, and the next pair of ducts nearest the pressure end of the valve connect to the next tallest anchor posts of the roof panel, and so on in this sequence.

An internal piston 46 travels along the length of the valve 40 for controlling fluid communication access to the ducts 38. When the piston 46 travels to the pressure end of the valve 40, the piston blocks the compressor 42 from fluid communication access to any of the ducts 38 and the air pump 44 has fluid communication access to all of the ducts. As the piston 46 travels towards the other end of the valve 40, the piston connects the compressor 42 in fluid communication to ducts 38 connecting to the valve between the pressure end of the valve and the side of the piston nearest the pressure end of the valve. Thus, moving the piston 46 from the pressure end of the valve 40 to the vacuum end sequentially connects the compressor 42 in fluid communication with each of the ducts 38 for inflating the tubes 28 of a roof panel 26 in the proper sequence. Conversely, moving the piston 46 from the vacuum end of the valve 40 to the pressure end reverses the order, and sequentially connects the air pump 44 in fluid communication with each of the ducts 38 for evacuating the tubes 28 of a roof panel 26 in the proper sequence.

Preferably, both the compressor 42 and the air pump 44 operate simultaneously. When the roof panels 26 thus extend, the compressor 42 inflates the tubes 28 one-by-one in the proper sequence. The air pump 44 simultaneously retains tubes 28 that have not been inflated yet, snugly within the trough 34 due to application of partial vacuum (negative air pressure). Conversely, when the roof panels 26 retract, the air pump 44 evacuates the tubes 28 one-by-one in the reverse sequence. Simultaneously, the compressor 42 retains the portion of a panel 26 that has not been retracted yet, relatively rigid through application of inflation air pressure. In this way, the roof 20 operates to extend and retract the panels 26 in a controlled manner. Alternatively stated, the roof panels 26 follow predefined paths during extension and retraction and will not fall into the stadium stands, playing areas, or other undesired locations.

Further, the roof panels 26 can be halted at virtually any position along these predefined paths. Specifically, the piston 46 may be halted at any position along the length of the valve 40 for selectively positioning a roof panel 26. The roof panels 26 can thus be partially extended or retracted for shade, acoustic control, wind deflection or other reasons.

Any known method may be used to cause the piston 46 to travel along the length of the valve 40, such as mechanical, electrical, hydraulic or a combination of such apparatuses. Other types of valves may be used as well, such as rotary-type valves or a combination of valves, either manually or computer controlled, that individually control fluid communication access to a duct 38.

Figure 12:
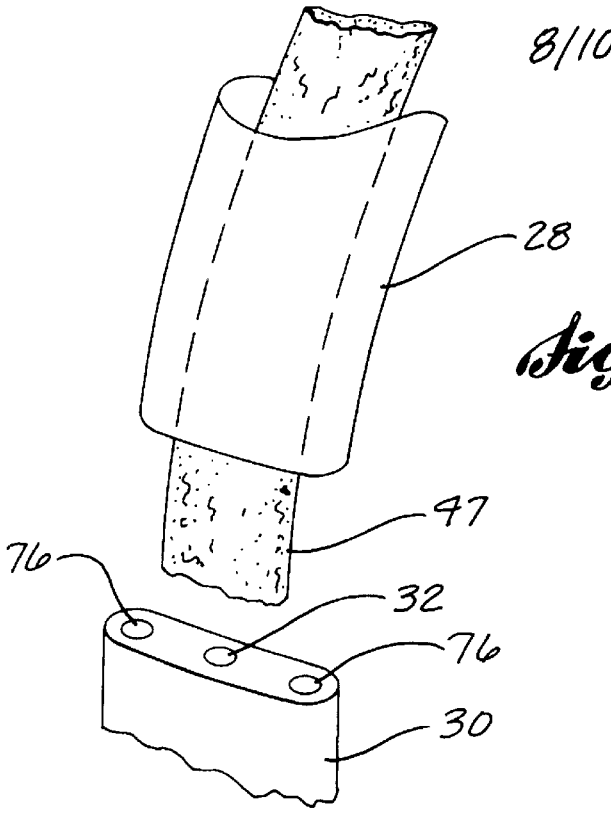
FIG. 12 illustrates a partially exploded, perspective view of one end of an inflatable tube and an anchor post of the roof of FIG. 1.

Referring to FIG. 12, a gas permeable material 47 extends from the end of each post 30 into a tube 28 for a distance along the length of the tube. When the air pump 44 evacuates the tubes 28, the gas permeable material 47 prevents the sides of a tube from collapsing against one another such that tubes cannot be evacuated.

Inflated tubes 28 in the roof 20 have a generally circular cross-section near the mid-length of each tube. Near an anchor post 30, inflated tubes have a generally oval cross-section. If the stadium 22 formed a generally circular shape having a diameter of approximately seven hundred feet, inflated tubes 28 in the roof 20 would have a diameter of approximately twenty feet at the mid-length of each tube. The major axis of the oval shape formed by each anchor post 30 would be approximately thirty feet in length for such a stadium 22. The minor axis of the oval shape of these anchor posts 30 would be approximately six inches in length. For inflating these twenty-foot diameter tubes 28, the compressor 42 could comprise a blower of several thousand horsepower (hp), which should inflate all the tubes of a roof panel 26 in about twenty minutes to a pressure of approximately 1.5 pounds per square inch (psi).

Figure 4A:
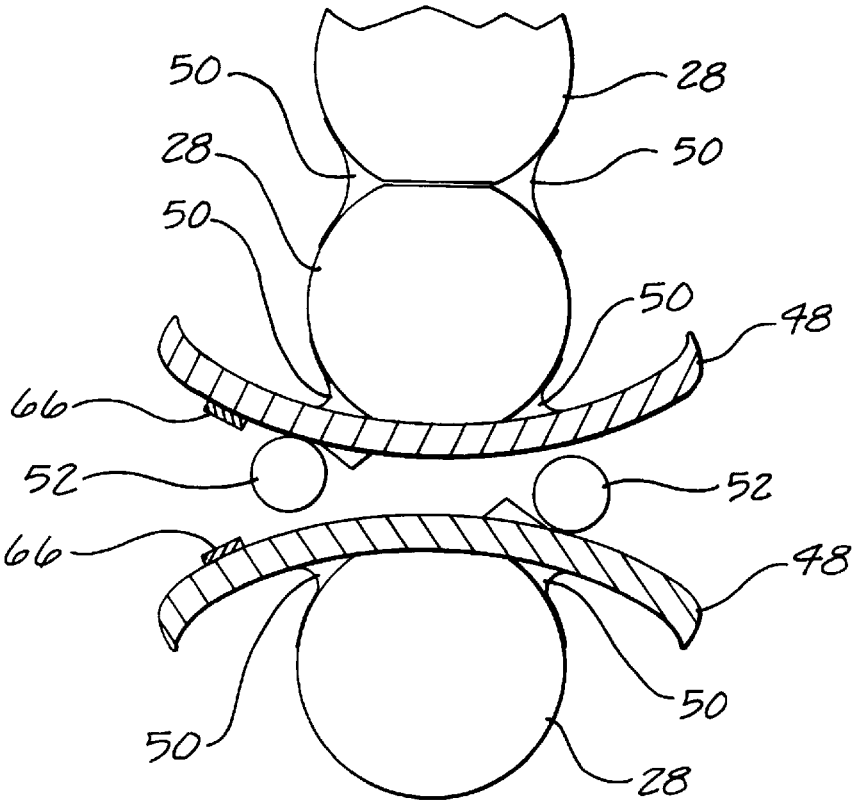
FIG. 4A illustrates a partial cross-sectional view of the roof of FIG. 1 with the roof panels nearly fully erected or extended, showing the system for selectively sealing and unsealing the roof panels to and from one another.

When the two panels 26 of the retractable roof 20 fully extend, the leading edge of the panels abut one another and can be sealed together using a vacuum system. Referring to FIGS. 2 and 4A, a sealing plate 48 extends along the length of the leading tube 28 of each of the panels 26. The sealing plate 48 mounts to the side of the leading tube 28 facing away from the panel 26 that the tube is a member of.

Figure 4B:
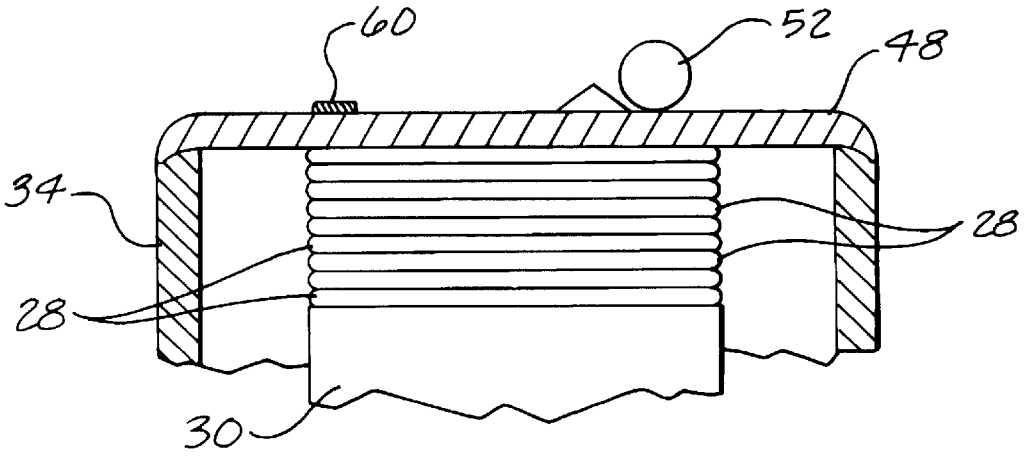
FIG. 4B illustrates a cross-sectional view of part of the base of the roof of FIG. 1 with a roof panel fully stored or retracted.

The sealing plate 48 has a generally smooth, arcuate shape forming a shallow curve. The concave side of this curve centrally receives the leading edge tube 28 of the roof panel 26 that the sealing plate 48 forms a part of. Each sealing plate 48 has a width at least equal to one-half the circumference of a tube 28 in the tube's inflated configuration. When a panel 26 retracts, the sealing plate 48 will thus cover the tubes 28 in their deflated, elongated configuration in the trough 34 as shown in FIG. 4B. The sealing plates 48 thus protect the tubes 28 from sun and weather when the roof panels retract into the trough 34.

One edge of a strip or strips of fabric 50 bonds along the length of each side of the leading tube 28 of a panel 26. The opposite edge of the fabric 50 connects along the length of the sealing plate 48 for retaining the sealing plate to the tube 28. Chemical agents specifically tailored to the material forming the tube 28 and the fabric 50 are used to bond the fabric to the tube. The fabric 50 may connect to the sealing plate 48 using any conventional method, such as fasteners and/or chemical bonding agents specifically tailored to the material forming the fabric and the sealing plate.

A seal tube 52, having a generally circular cross-section, mounts to the convex side of each sealing plate 48. The seal tubes 52 each extend along the lengths of the sealing plates 48, offset from the centerline of each sealing plate. One seal tube 52 mounts to one side of the center line of its respective sealing plate 48, and the other seal tube 52 mounts to the opposite side of its respective sealing plate, relative to the first seal tube.

When the roof panels 26 fully extend to enclose the stadium 22, the two panels abut one another. In particular, the seal tube 52 of one roof panel 26 contacts the sealing plate of the opposite roof panel. The fully extended roof panels 26 thus "sandwich" the seal tubes 52 between the sealing plates 48 of the roof panels, wherein the seal tubes are offset from one another. The offsetting of the sandwiched seal tubes 52 encloses a space between the sealing plates 48. A partial vacuum can be applied to this space for sealing the two plates 48, and thus the panels 26, to one another. The seal tubes 52 are preferably formed from a relatively soft polymer so that the seal tubes compress between the panels 26 and function as a gasket for application of the partial vacuum. The seal tubes 52 may be either solid or hollow. As shown in FIG. 4A, the seal tubes 52 have a cross-sectional area substantially smaller than the cross-sectional area of an inflated tube 28 in the main body section of a roof panel 26.

Figure 16:
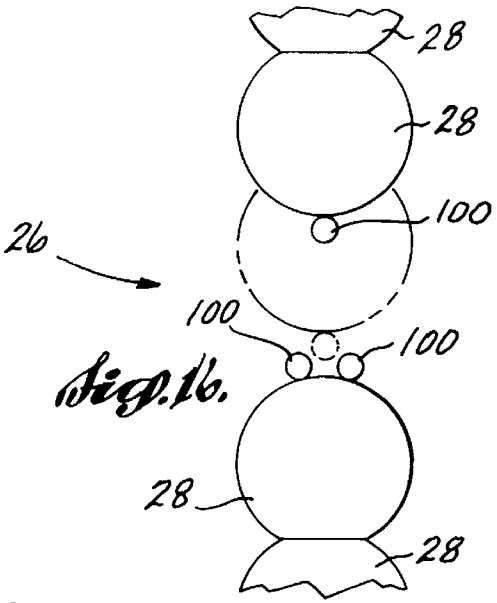
FIG. 16 illustrates a partial cross-sectional view of the roof of FIG. 1 employing another embodiment of a system in accordance with the present invention for selectively sealing and unsealing roof panels to and from one another.

FIG. 16 illustrates another embodiment of a system for selectively sealing the roof panels 26 to one another. Rather than a sealing plate 48, the system in FIG. 16 employs three sealing segments 100. The sealing segments 100 are tubular, having a cross-sectional area substantially smaller than the cross-sectional area of a tube 28 in the main body section of a panel 26.

A single sealing segment 100 connects to one of the roof panels 26, and the remaining two sealing segments connect to the other roof panel. The sealing segments 100 each mount to the leading tube 28 of its respective roof panel 26, and extend along the length of the tube. Each sealing segments 100 mounts to the side of the leading tube 28 facing away from the panel 26 that the tube is a member of.

The single sealing segment 100 mounts centrally to the leading tube 28 of one of the roof panels 26. The other two sealing segments 100 mount a spaced distance from one another to the leading tube 28 of the other roof panel 26. The space between these other two sealing segments 100 defines a channel extending centrally along the length of the tube 28 that this pair of sealing segments mount to.

When the panels 26 fully extend, the single sealing segment 100 extends partially into the channel defined between the other two sealing segments. The channel has a width less than the diameter of a sealing segment 100. Therefore, as the single sealing segment 100 extends into the channel, the sides of the sealing segment press against the walls of the channel and enclose a space extending along the edge of each panel 26. The roof 20 applies a partial vacuum to this space for sealing the two panels 26 to one another.

Alternatively, the single sealing segment 100 may be inflatable. The panels 26 initially extend with the single sealing segment 100 deflated or evacuated. The evacuated single sealing segment 100 occupies a smaller space and thus enters into the channel defined between the other two sealing segments when the panels 26 fully extend. Thereafter, the roof 20 inflates the single sealing segment 100 such that it presses against the walls of the channel and seals one panel 26 to another. Fabric strips 50 as previously described in connection with the sealing plates 48 may be used to mount sealing segments 100 to the leading tube 28 of a panel 26.

Figure 6:
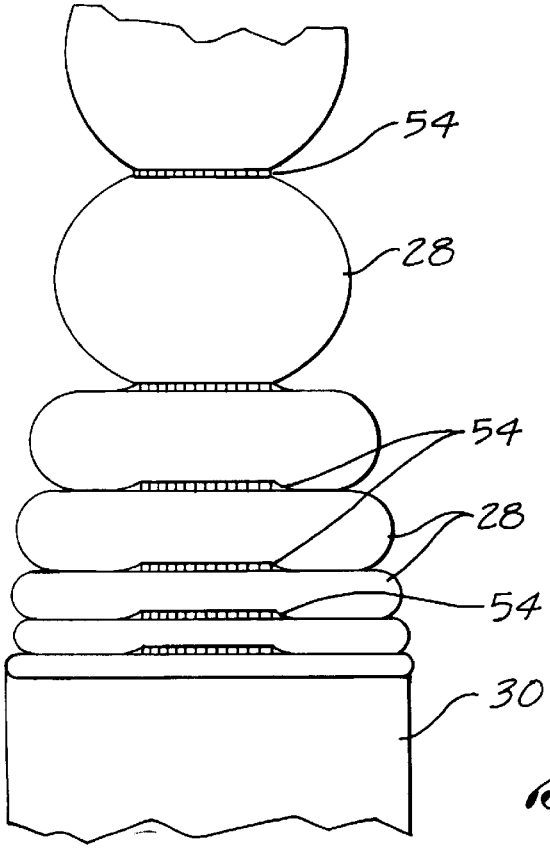

Two adjacent tubes 28 in a panel 26 seal to one another along the length of each tube using different methods, depending on the location along the lengths of the tubes. Near either end of two adjacent tubes 28, the tubes slip along their lengths relative to one another during extension and retraction of a panel 26. The amount of slippage depends on the spacing of the posts 30 anchoring the end of the tubes 28 and the angular travel of the tubes during inflation and deflation. The amount of such slippage becomes insignificant beyond a distance approximately one-third of a tube-length from either end of a tube 28. Referring to FIG. 6, labyrinth seals 54 seal adjacent tubes 28 to one another for approximately one-third of each tube's length from either end of the tubes.

Labyrinth seals 54 allow the tubes 28 to shift relative to one another along the length of the tubes. However, the labyrinth seals 54 substantially prevent transverse movement of tubes 28 relative to one another, and substantially prevent moisture, such as rain, from penetrating between two adjacent tubes.

Figure 8:
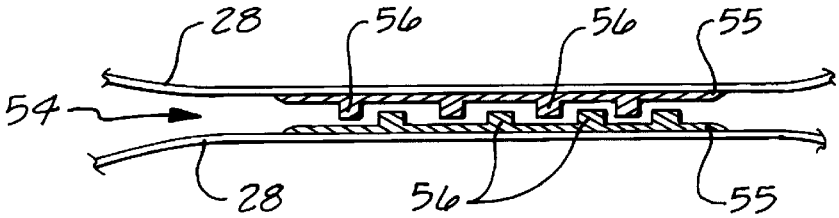

Referring to FIG. 8, each labyrinth seal 54 includes a pair of rib assemblies 55 facing one another between a pair of adjacent tubes 28. One rib assembly 55 extends along the length of one tube 28 of the two adjacent tubes, and the other rib assembly extends along the length of the other tube facing the first rib assembly. Chemical agents specifically tailored to the materials forming the tubes 28 and the rib assemblies 55, bond a rib assembly to the length of a tube.

Each rib assembly 55 includes several, spaced-apart ribs 56 extending along the length of the assembly. The rib assemblies 55 connect between adjacent tubes 28 such that the rib assemblies are offset by the thickness of one rib 56 from one another. Thus, the spaces between one rib assembly 55 receive the ribs 56 of the other rib assembly, and vice-versa in an interlocking arrangement. The interlocking ribs 55 thus permit movement along the length of two adjacent tubes 28.

The interlocking ribs 56 also substantially prevent moisture from penetrating through the seal 54. Further, the ribs 56 may be formed of, or coated with a conventional hydrophobic material. Therefore, when the ribs 56 interlock with one another, two hydrophobic surfaces will contact one another, and repel moisture from both surfaces for a greater moisture sealing effect.

Figure 17:
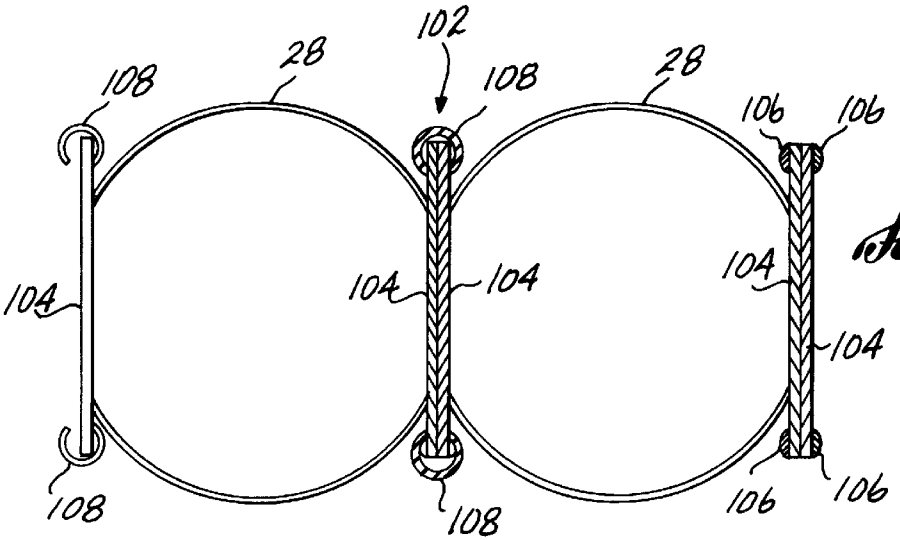
FIG. 17 illustrates a schematic cross-sectional view of the roof of FIG. 1 showing another embodiment of a system in accordance with the present invention for connecting tubes of the roof to one another.

FIG. 17 illustrates another embodiment of a seal 102 for permitting adjacent tubes 28 to slip or shift along their lengths relative to one another. This seal 102 includes a least one plate 104 for each tube 28. The plate 104 connects to the side of each tube 28 adjacent another tube 28, such that the plates of adjacent tubes contact one another. The edge of each plate 104 extends into, and along the cusp defined between adjacent tubes 28. A rib 106 extends along each of these plate edges, facing away from the adjacent tube 28. A conduit 108 receives these plate edges.

More particularly, the conduit 108 includes a slot extending along its length The slot slides over the thickness of two adjacent plates 104 past the ribs 106 of the plates. The thickness of the ribs 106 and the narrowness of the slot retains the edges of the plates 104 within the conduit 108. However, the plates 104, and thus the tubes 28, can shift along their lengths relative to one another along the length of the conduit 108. The seal 102 therefore permits adjacent tubes 28 to shift along their lengths relative to one another, while substantially preventing moisture from penetrating through adjacent tubes.

Figure 5:
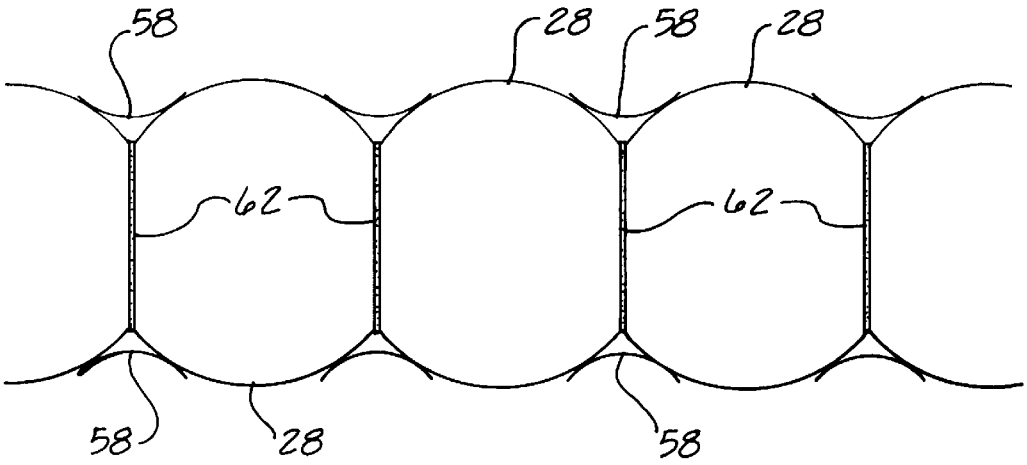
FIGS. 5 through 8 illustrate schematic partial cross-sectional views of the roof of FIG. 1 showing systems for connecting tubes of the roof to one another.

Approximately the central one-third of each tube's length is sealed to an adjacent tube 28 using a bond-type seal 58 as shown in FIG. 5. Along this section of the tubes' lengths, the tubes 28 do not significantly shift or slip along their lengths relative to one another during inflation and evacuation, thus permitting use of a bond-type seal 58. The bond-type seal 58 includes a strip or strips of fabric running along the length of the cusp defined between two adjacent tubes 28. One edge of the fabric strip or strips bonds to one of the tubes 28, and the opposite edge bonds to the other tube. Bond-type seals 58 preferably connect at least the outer peripheries of adjacent tubes 28 to one another, and may also connect the inner peripheries together as well. At least the fabric's outer surface is treated with a water repellent substance to prevent moisture from penetrating the seals 58. Chemical bonding agents specifically tailored to the material forming the tubes 28 and fabric are used for bonding the fabric to the tubes.

Figure 7:
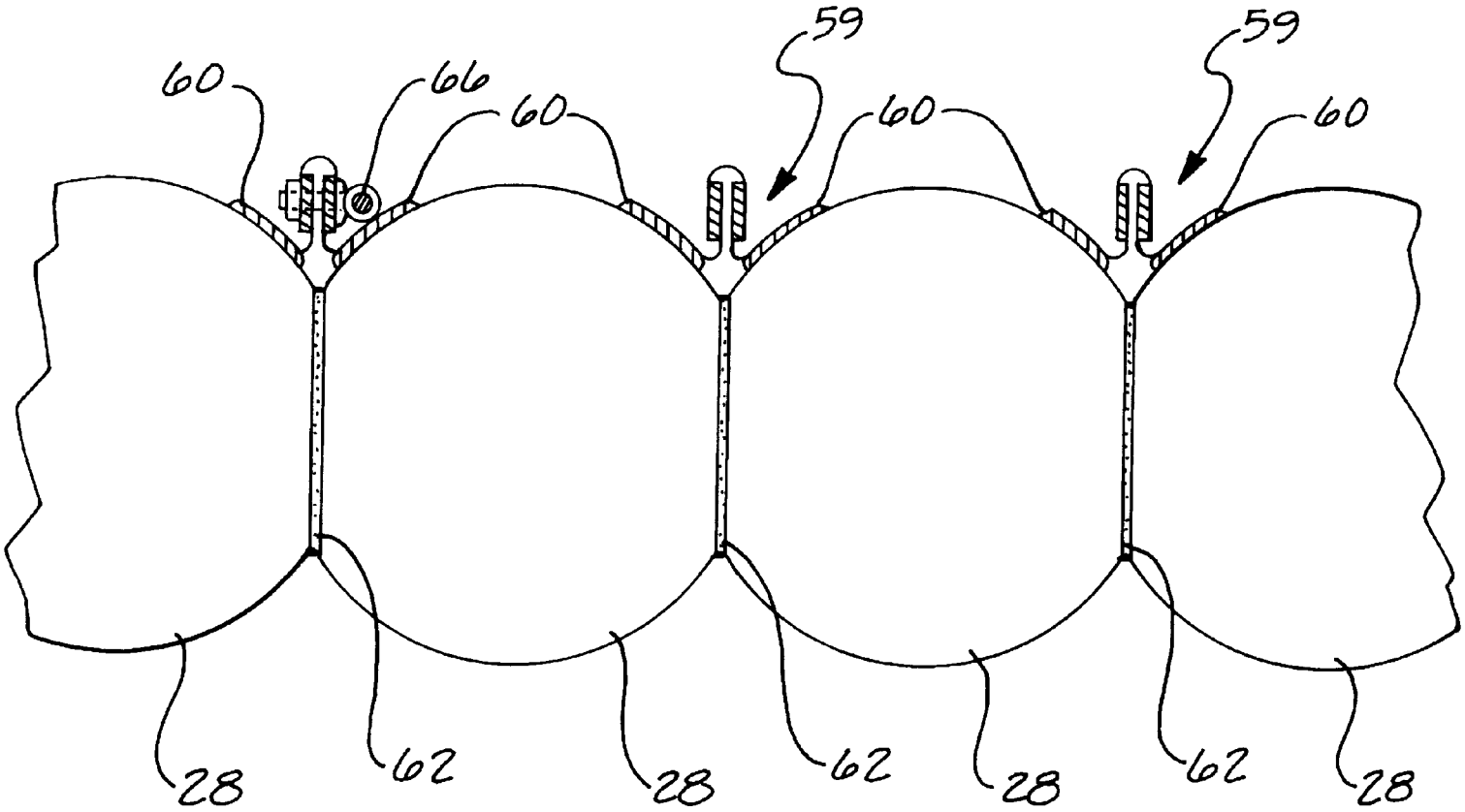

To facilitate field assembly of adjacent tubes 28 to one another, a bond-type seal 59 as shown in FIG. 7 may be used. In this bond-type seal 59, at least two fabric strips 60 run along the cusp between two adjacent tubes 28. One edge of one fabric strip 60 bonds to one of the tubes 28, and an edge of the other fabric strip bonds to the other tube. The remaining edges of the fabric strips 60 then bond to one another. In particular, the edge of the each fabric strip 60 not bonded to a tube 28, bends away from the tubes 28 so that each strip forms a shape corresponding generally to the letter "V". One leg of the V-shape bonds to a tube 28, and the other leg bonds to the corresponding leg of the V-shape formed by the other fabric strip 60. This arrangement permits maximum deflection of one tube 28 relative to another, with minimal stress on the attachment between the tubes. Any conventional method may be used to fasten the two fabric strips 60 together, such as sewing, fasteners and/or chemical bonding agents specifically tailored to the fabric material.

The bond-type seals 58 and 59 may also including bonding to adjacent tubes 28 to one another along the area of contact 62 between the two tubes. The tubes 28 are made of a polymer material, and therefore may be heat sealed or ultrasonically welded to one another in this area of contact 62. Alternatively, bonding agents, such as with the fabric in the bond-type seals 58 and 59 may be used.

The roof 20 preferably includes lightning rods 64 for protection against lightning strikes as shown in FIGS. 1, 11A and 11B. Preferably, at least one lightning rod 64 mounts to each of the sealing plates 48 illustrated in FIG. 4A. (Only the grounding cable 66 for the lightning rods 64 may seen in the cross-sectional view of FIG. 4A.) A bond-type seal 59 as shown in FIG. 7 may also carry a ground cable 66. In particular, the ground cable 66 attaches to the portion of the bond-type seal 59 having the edges of the two fabric strips 60 bonded to one another.

Figure 9:
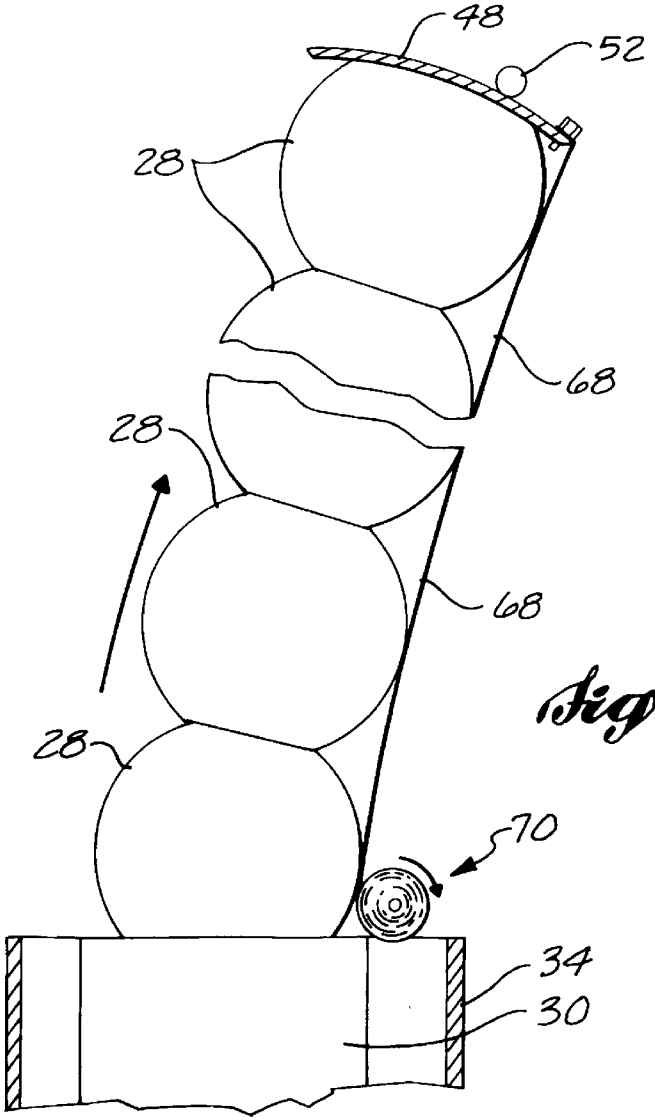
FIG. 9 schematically illustrates a system for providing a special purpose lining for the interior of the roof of FIG. 1.

Referring to FIG. 9, the interior of the roof panels 26 may be covered by a special lining 68. The lining 68 rolls and unrolls from a dispenser 70 as a roof panel 26 extends or retracts. The leading edge of the lining 68 attaches to the stadium-facing edge of the sealing plate 48 of a roof panel 26 or to the stadium-facing side any tube 28. As the roof panel 26 extends, the lining 68 unrolls from the dispenser 70 to cover an area of the interior of the roof panel. Different linings 68 may be used depending on what event is occurring in the stadium 22. For example, some linings 68 may be for receiving a video projection, while other linings may be for acoustic reflection or absorption.

Figure 10:
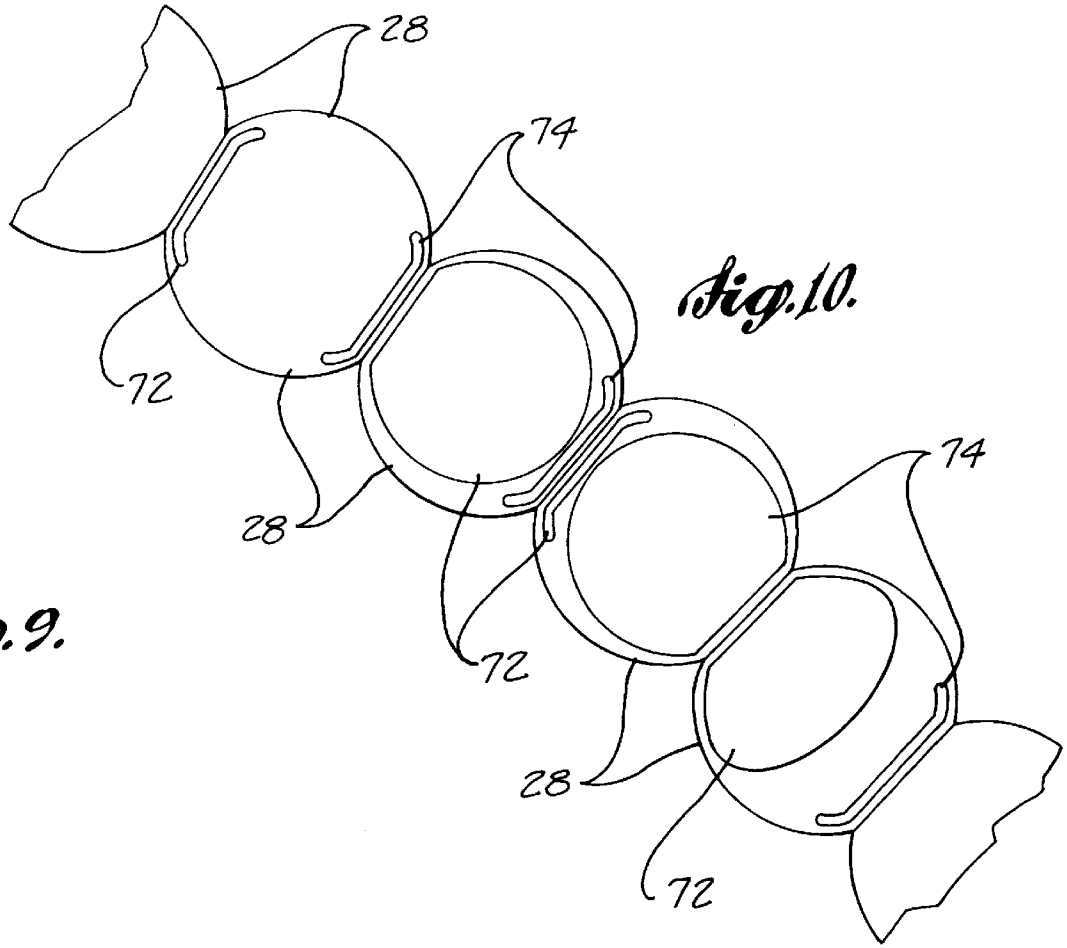
FIG. 10 schematically illustrates a system for filtering and/or blocking the transmission of light through the roof of FIG. 1.

Preferably, the tubes 28 of the roof panels 28 are translucent for allowing sunlight to pass through the tubes. However, on bright, sunny days, too much sunlight may pass through the tubes 28 and cause an unacceptable temperature increase in the stadium 22. Further, some events in the stadium may require subdued lighting, or even darkness. For this reason, each tube 28 includes two inner tubes 72 and 74 as shown in FIG. 10. One inner tube 72 is formed from a translucent, colored material for serving as a light filter. The inner tube 74 is formed from an opaque material for blocking light.

When not in use, the roof 20 retains the inner tubes 72 and 74 deflated within the main tubes 28. Referring to FIG. 3, each anchor post 30 includes a central port 32, and a port 76 and 78 on opposite sides of the central port. The inner port 32 in each post 30 controls inflation and deflation of the main tube 28. One of the side ports 76 controls inflation and deflation of one of the inner tubes 72, and the other side port controls inflation and deflation of the other inner tube 74.

Separate air lines or ducts 80 connect the side ports 76 and 78 of a panel 26 to the air compressor 42 and the air pump 44. When not needed, the air pump 44 retains the inner tubes 72 and 74 deflated and evacuated against opposite walls of an outer tube 28. For filtering or blocking sunlight, the air compressor 42 inflates the inner tubes 72 and 74 with a pressure greater than the pressure inflating the outer tube 28 so that the inner tubes will inflate. The air compressor 42 may inflate only one of the inner tubes 72 or 74, or partially inflate both to achieve a desired mix of shade, color, light transmission or solar heat gain. Separate valving 110 and 112 may be included for controlling inflation and evacuation of the inner tubes 72 and 74.

For a generally circular stadium 22 having a diameter of approximately 700 feet, the outer tubes 28 inflate to a nominal pressure of 1.5 psi. In this implementation, the inner tubes 72 and 74 will inflate to a nominal pressure of 1.7 psi when needed. Pressure relief valves and/or regulators (not shown) preferably regulate the inflation pressure in the outer tubes 28. Therefore, as the inner tubes 72 and/or 74 inflate, the valving system maintains the pressure in the outer tubes 28 within acceptable levels.

Figure 15:
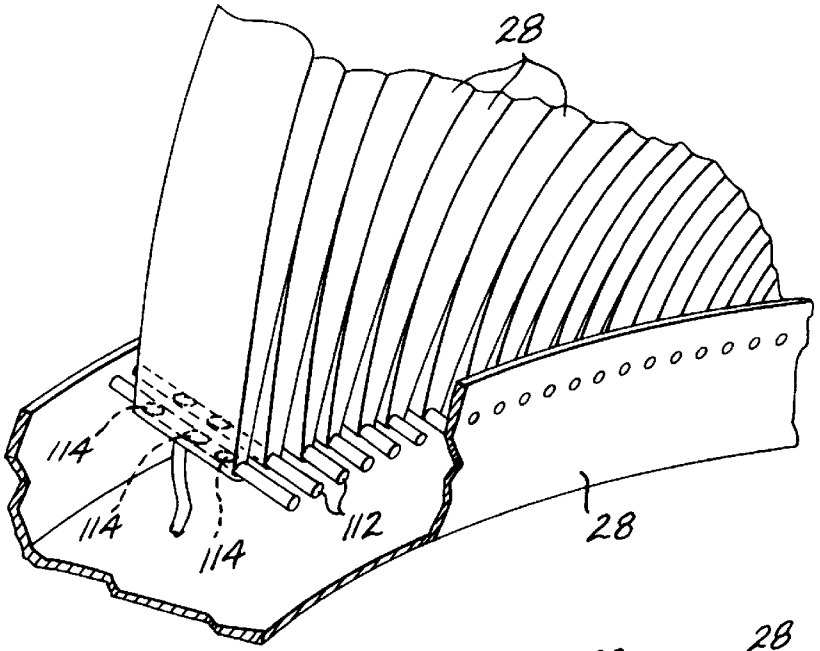
FIG. 15 illustrates a perspective view of part of the base of the roof of FIG. 1 employing another embodiment of a system in accordance with the present invention for anchoring the ends of tubes of the roof to the roof base.

FIG. 15 illustrates an alternative system for anchoring the ends of the tubes 28 in the trough 34. Rather than employing vertical anchor posts 30, the system in FIG. 15 relies upon a plurality of spaced apart horizontal anchor posts 112 These horizontal anchor posts 112 may be pipes that each extend from one side wall of the trough 34 to the other. The end of each tube 28 extends into the trough 34 and a horizontal anchor post 112 extends through the width of the tube. The portion of the tube 28 extending below a post 112 folds upward and seals to the exterior of the tube.

Air flows through ports 114 in the sides of the posts 112 for inflating and evacuating the tubes 28. The posts 112 may rotatably mount to the trough side walls using pipe unions or other conventional methods such that the posts rotate as a panel 26 extends and retracts. Further, the posts 112 may mount at different heights along the trough's side walls such that evacuated tubes 28 will lie generally horizontally on top of other evacuated tubes in the trough 34.

Figure 13:
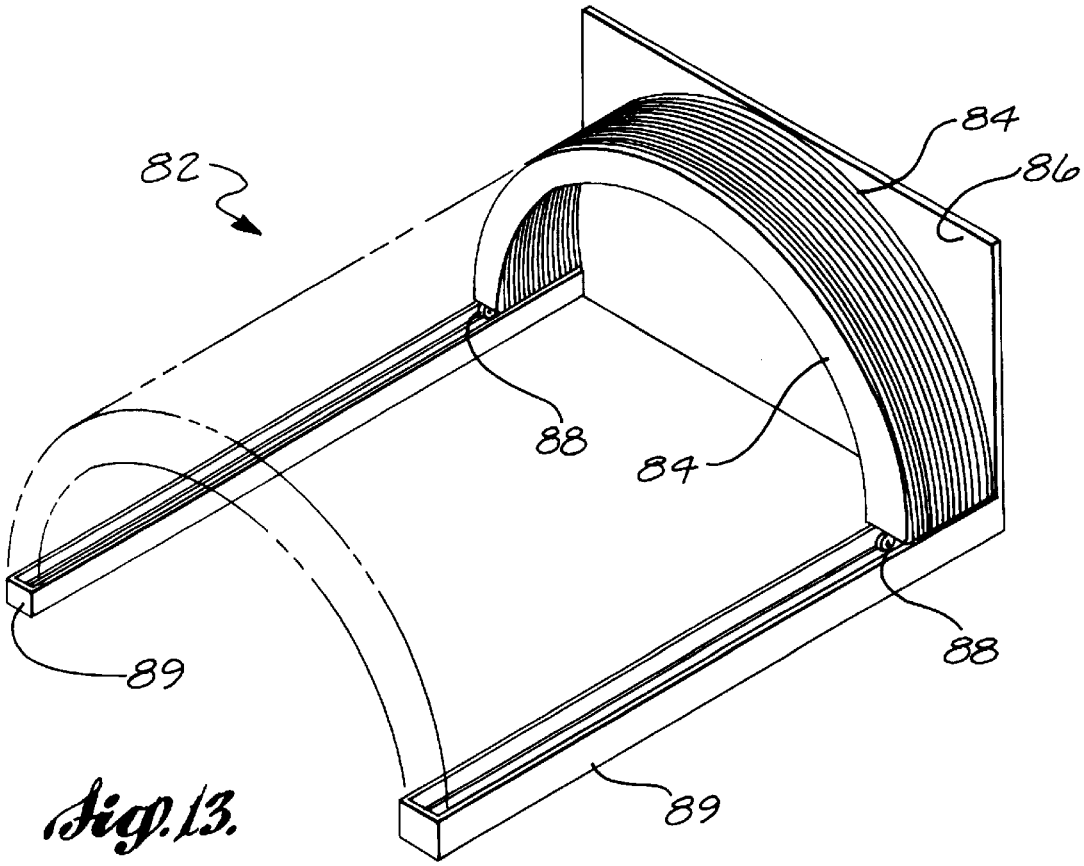
FIG. 13 illustrates a schematic, perspective view of another embodiment of a roof in accordance with the present invention.

FIG. 13 illustrates another preferred embodiment of a pneumatically convertible roof 82 in accordance with the present invention for retraction and extension from the side of a wall 86. The roof 82 includes a plurality of inflatable, arcuate tubes 84, connected to one another along their lengths in a continuous side-by-side relationship. A first one of the tubes 84 connects to the wall 86 along the length of the tube.

One end of each tube 86 connects to one side of the base of the roof 82, and the other end connects to the opposite side of the roof's base. The ends of the tubes 84 connect to rollers 88 that roll along tracks 89. Air lines (not shown) connect to, and move with the rollers 88 for inflating the tubes 84. When an air compressor (not shown) sequentially inflates the tubes 84, the tubes inflate and expand away from the wall 86 on the rollers 88. When inflated, the tubes 84 collectively form a half-tubular roofing structure extending from the wall 86. When not in use, the tubes 86 sequentially evacuate and move back on the rollers 88 to press against the wall 86. An air pump (not shown) sequentially applies a partial vacuum such that the tubes 84 evacuate, and press against one another in the direction towards the wall 86. The tubes 84 additionally may include a supporting rib (not shown) for retaining the tubes in an arcuate shape when evacuated.

Figure 14:
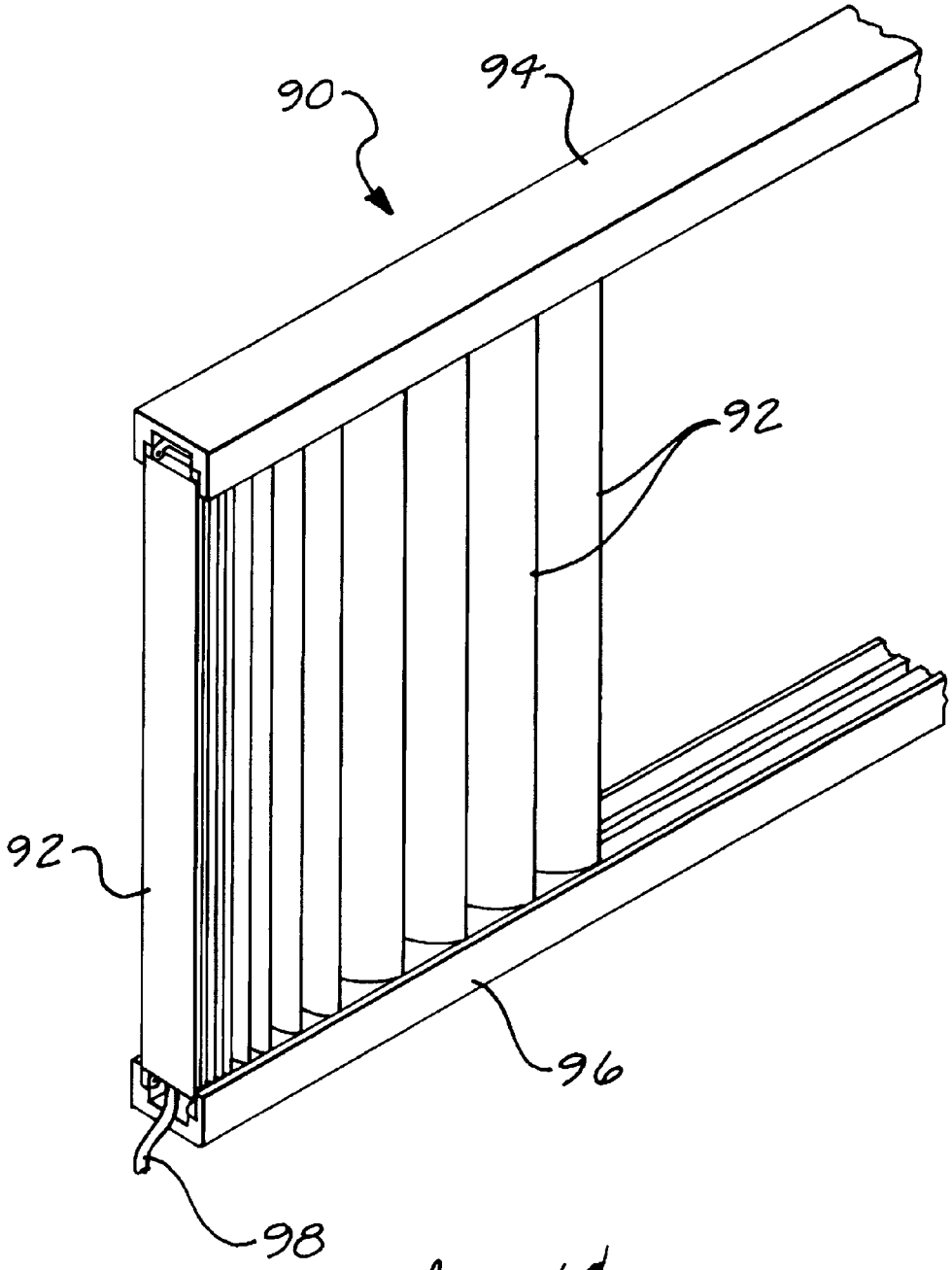
FIG. 14 illustrates a schematic, perspective view of an embodiment of a door in accordance with the present invention.

FIG. 14 illustrates a preferred embodiment of a pneumatically convertible door 90 in accordance with the present invention. The door 90 includes a plurality of inflatable tubes 92, connected to one another along their lengths in a continuous side-by-side relationship. The tubes 92 extend generally vertically, with the upper and lower ends of each tube being respectively disposed in upper and lower roller track mechanisms 94 and 96. The roller track mechanisms 94 and 96 define the top and bottom edges of the door 90.

Air lines 98 connect to the end of each tube 92 through the lower roller track mechanism 96 for inflating and evacuating the tubes 92. When the tubes 92 inflate, the tubes expand along the roller tracks 94 and 96, which closes the door 90. When the tubes 92 evacuate, the tubes collapse and press against one end of the door 90, which opens the door. An air compressor/pump (not shown) pumps air into and out of the tubes 92 as necessary for inflation and evacuation. When deflating the tubes 92, the air compressor/pump sequentially applies a partial vacuum to the tubes. The sequence starts with the leading tube of the door 90, and progressively moves tube-by-tube to the tube furthermost from the leading tube. This causes the tubes 92 to press against one side of the door 90 for retaining the door in an open condition.

While the preferred embodiments of the invention have been illustrated and described, it will be appreciated that various changes can be made therein without departing from the spirit and scope of the invention. For example, other methods could be used to seal two roof panels 26 to one another, such as electromagnetic methods. In view of these and other alterations, substitutions and modifications that could be made by one of ordinary skill in the art, it is intended that the scope of letters patent granted hereon be limited only by the definitions of the appended claims.

The embodiments of the invention in which an exclusive property or privilege is claimed are defined as follows:

1. A convertible roof, comprising:

(a) a base having a first side, a second side and first and second opposing ends;

(b) a plurality of tubular inflation posts disposed on each side of the base;

(c) a first panel including a plurality of inflatable tubes, each tube having a first end mounted to one of the tubular inflation posts on one side of the base, and a second end mounted to one of the tubular inflation posts on the other side of the base; and (d) an air pump connected to the tubular inflation posts for inflating each tube through a tubular inflation post.

2. The convertible roof of claim 1, wherein the tubular inflation posts comprise a pipe extending through each tube.

3. The convertible roof of claim 1, wherein the each tube includes an interior having a gas permeable material, the gas permeable material running along at least a portion of the length of each tube.

4. The convertible roof of claim 1, wherein the air pump causes the first panel to move by air pressure from a first position extending along one end of the base, to a second position above the base when the tubes are inflated for covering the base.

5. The retractable roof of claim 4, wherein the tubes each include a generally rounded exterior when inflated, the tubes collectively forming an interior side and an exterior side of the panel, the interior side being generally directed towards the base when the panel is in the second position, further comprising a lining for covering the rounded exterior of at least a portion of at least some tubes and thus lining a section of the interior side of the panel when the panel is in the second position.

6. The convertible roof of claim 4, further comprising a second panel including a plurality of inflatable tubes, each tube of the second panel having a first end connected to the first side of the base, and a second end connected to the second side of the base, wherein the tubes of the second panel move under the influence of inflation air pressure from a first position extending along the second end of the base, to a second position above the base contacting the first panel when the tubes of the first and second panels are inflated.

7. The convertible roof of claim 6, further comprising vacuum sealing means for sealing the first panel to the second panel when the two panels contact one another by application of a partial vacuum.

8. The convertible roof of claim 1, wherein at least some of the tubes are light control tubes, each light control tube including an interior having first and second sides, and a light blocking section in the interior of the light control tube, the light blocking section being connected to one side of each light control tube, and being inflatable for blocking significantly more light than when deflated.

9. The convertible roof of claim 1, wherein the base includes a trough.

10. The retractable roof of claim 1, further comprising sealing means for sealing one tube to an adjacent tube that permits the two tubes to move relative to another along the length of each tube.

11. The retractable roof of claim 1, further comprising a labyrinth seal for sealing one tube to an adjacent tube.

* * * * *